US005662383A

United States Patent [19]

Hand

[11] Patent Number: 5,662,383

[45] Date of Patent: Sep. 2, 1997

[54] APPARATUS FOR ATTACHING FABRIC TO A CHAIR FRAME

[75] Inventor: Joseph M. Hand, Sheboygan Falls, Wis.

[73] Assignee: Bemis Manufacturing Company, Sheboygan Falls, Wis.

[21] Appl. No.: 690,797

[22] Filed: Aug. 1, 1996

Related U.S. Application Data

[60] Provisional application No. 60/002,218 Aug. 11, 1995.

[51] Int. Cl.[6] ..... A47C 7/00

[52] U.S. Cl. ..... 297/440.11; 297/452.18

[58] Field of Search ..... 297/440.11, 451.11, 297/452.18, 226, 452.13, 218.3, 218.4, 218.5, 451.13, 452.2

[56] References Cited

U.S. PATENT DOCUMENTS

| | | | |
|---|---|---|---|
| 3,512,834 | 5/1970 | Lockshin | 297/440.11 |
| 3,844,612 | 10/1974 | Borggren et al. | 297/440.11 X |
| 4,566,731 | 1/1986 | Marchesini | 297/440.11 X |
| 5,015,034 | 5/1991 | Kindig et al. | 297/440.11 X |
| 5,338,091 | 8/1994 | Miller | 297/226 X |

FOREIGN PATENT DOCUMENTS

| | | | |
|---|---|---|---|
| 3632278 | 4/1987 | Germany | 297/218.3 |
| 3732836 | 12/1988 | Germany | 297/218.3 |

*Primary Examiner*—Milton Nelson, Jr.
*Attorney, Agent, or Firm*—Michael, Best & Friedrich

[57] ABSTRACT

A chair assembly including a frame defining a channel and a deflectable wall, a retainer receivable by the channel and engageable with the deflectable wall, and a web of fabric located in said channel and engageable with the retainer.

20 Claims, 3 Drawing Sheets

44
90
86
94
90
86
34
80
82
114
98
110
94
90
4
4
90
22
38

44
38
122
44b
126
106
70
47
110
78
98

57
62
70
56
66
78
64a
90
86
94
114
106
57
50

44
118
114
110
47
78
98
94
44a
106
90
70
86
34

APPARATUS FOR ATTACHING FABRIC TO A CHAIR FRAME

RELATED APPLICATIONS

Applicant claims the benefit under 35 USC 119 of copending U.S. Provisional patent application Ser. No. 60/002,218, filed Aug. 11, 1995.

BACKGROUND OF THE INVENTION

1. Technical Field

The invention relates generally to furniture, and more particularly to the attachment of cloth to a furniture frame.

2. Related Prior Art

It is generally known to attach webs or straps of fabric to a plastic or metal chair frame in order to provide a support surface, i.e., a seat or backrest. U.S. Pat. 4,552,405 discloses an example of such a structure including means for attaching the fabric to the chair frame.

Various other arrangements for attaching fabric or upholstery to a furniture frame are also known.

SUMMARY OF THE INVENTION

One of the disadvantages of known chairs including a chair frame and fabric support surface is that the fabric is permanently fixed to the chair frame. When the fabric is permanently fixed to the chair frame, cleaning and maintenance of the fabric is made more difficult. Also, permanent attachment of the fabric to the chair frame precludes the possibility of replacing the fabric with a substitute piece of material. Nevertheless, it is imperative that the fabric be securely attached to the chair frame to assure the integrity of the support surfaces.

Accordingly, the invention provides a chair including a chair frame, a web of fabric and means for releasably fastening the web to the frame. More particularly, in one embodiment, the invention provides a chair assembly comprising a frame including a channel and a resiliently deflectable wall, a retainer received by the channel and removably secured in the channel by the deflectable wall, and a web of fabric located in the channel and engaged with the retainer and the frame, whereby the web is releasably fixed to the frame.

In another embodiment, the invention provides a chair assembly comprising a frame, a web of fabric, and means for releasably attaching the web to the frame, the means including, on the frame, a fixed wall and a deflectable wall spaced from the fixed wall, the means including a retainer received between and engaged by one of the fixed and deflectable walls and by the web, whereby the retainer is removably secured to the frame.

The invention provides advantage by affording assembly of the chair, and selective removal of the fabric from the chair frame. Moreover, assembly and disassembly of the chair does not require any tools.

The chair provides a rigid, light weight frame with a removable fabric web that provides a support surface. The chair thus provides a comfortable, breathable support surface that can be easily replaced or removed for aesthetic or maintenance purposes. Such advantages are not met by chairs made entirely of plastic or by chairs having permanently attached fabric.

In addition, the fabric is releasably fixed to the chair frame along a length of the fabric in a manner minimizing stress concentrations on the fabric, thereby reducing the likelihood of tearing or fraying of the fabric.

Other features and advantages of the invention will become apparent to those skilled in the art upon review of the following detailed description, claims and drawings.

Figure 1:
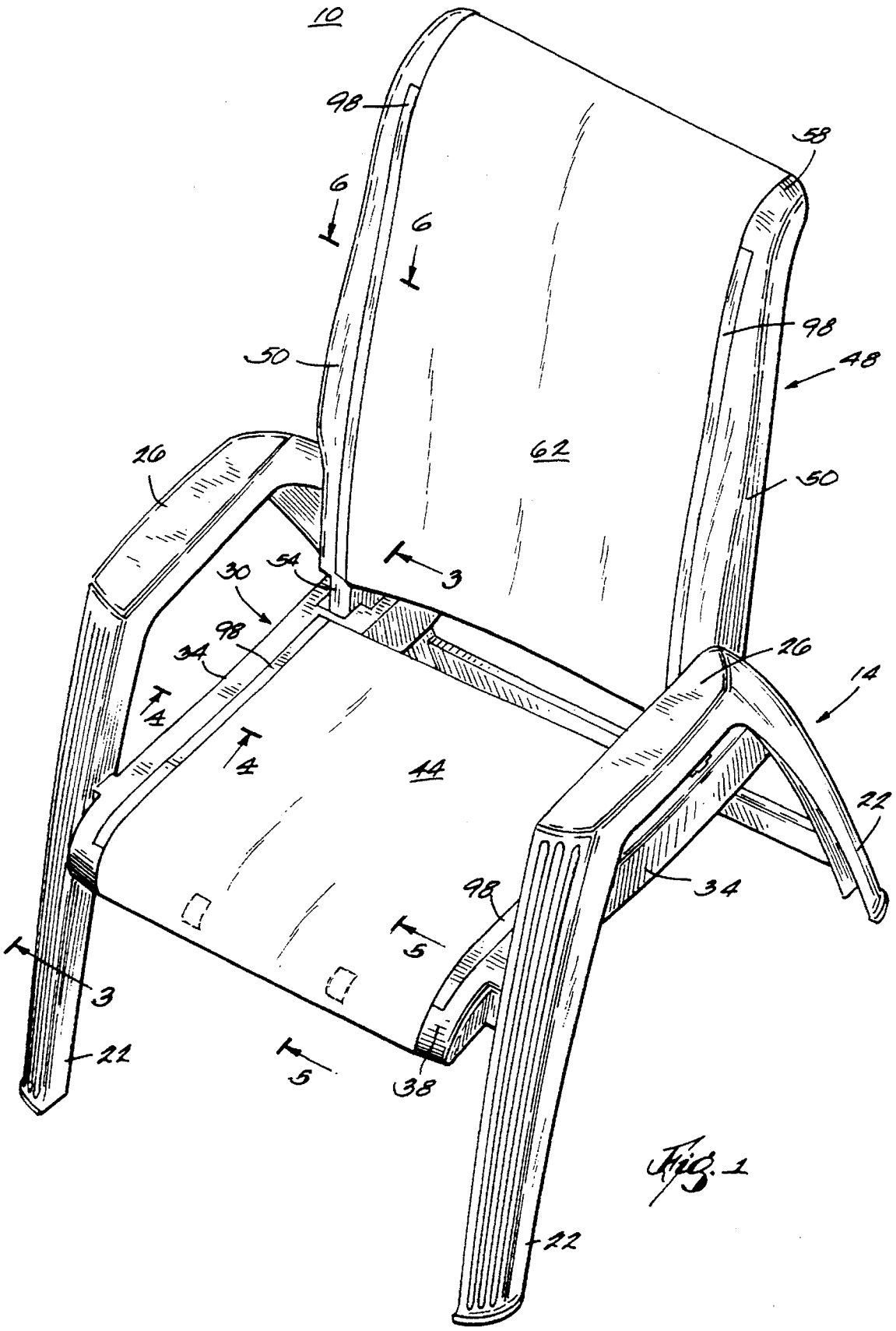
FIG. 1 is a perspective view of a chair embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The drawings illustrate a chair 10 which embodies the invention, which is preferably made of injection molded plastic, and which has a sling-like fabric seat and backrest. Referring first to FIG. 1, the chair 10 includes a seat frame 14 including four legs 22, two armrests 26 extending between the upper ends of respective pairs of legs 22, and a seat 30 supported by the legs 22.

Figure 2:
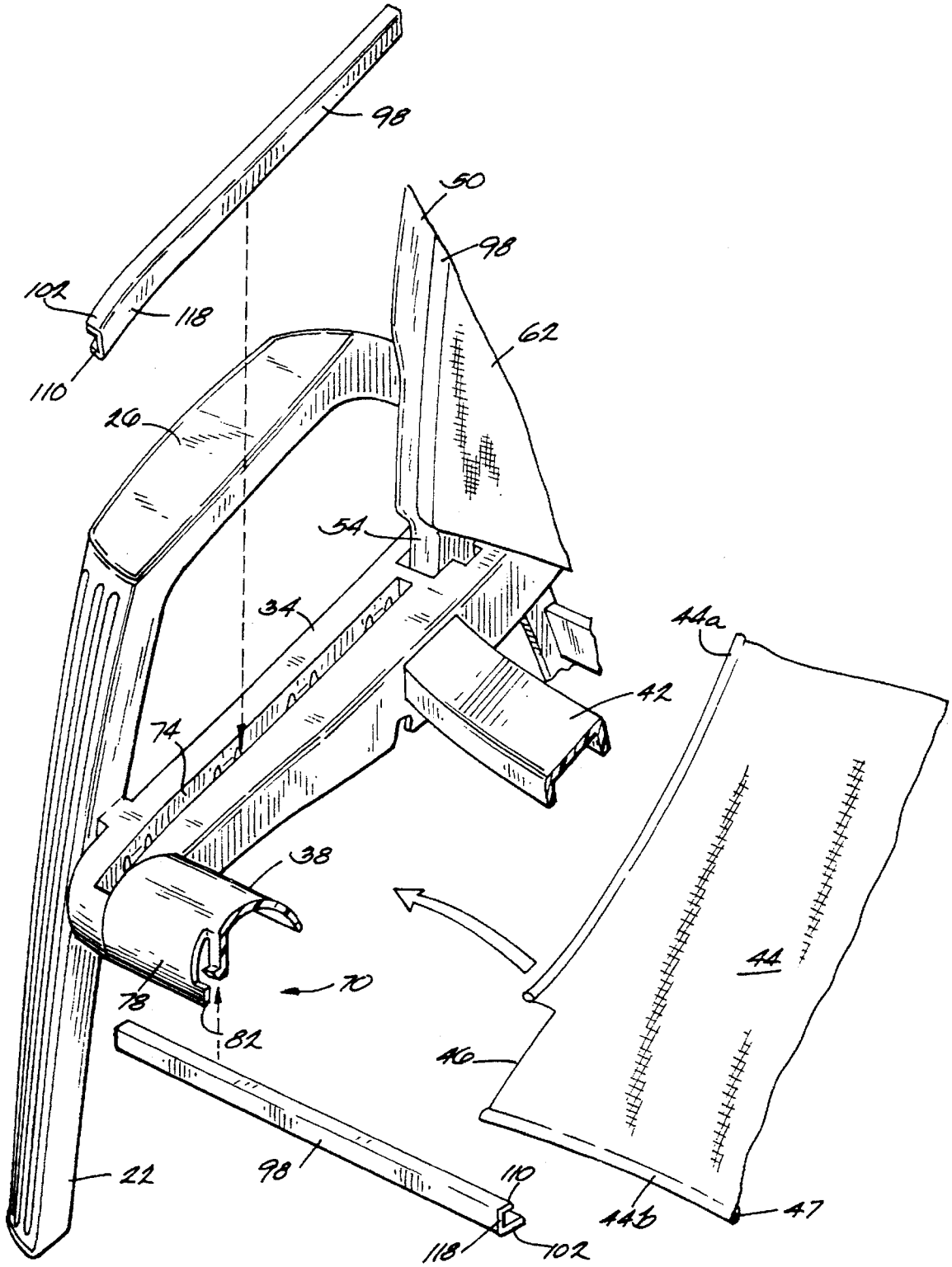
FIG. 2 is an enlarged, exploded view of a portion of the chair shown in FIG. 1.
Figure 3:
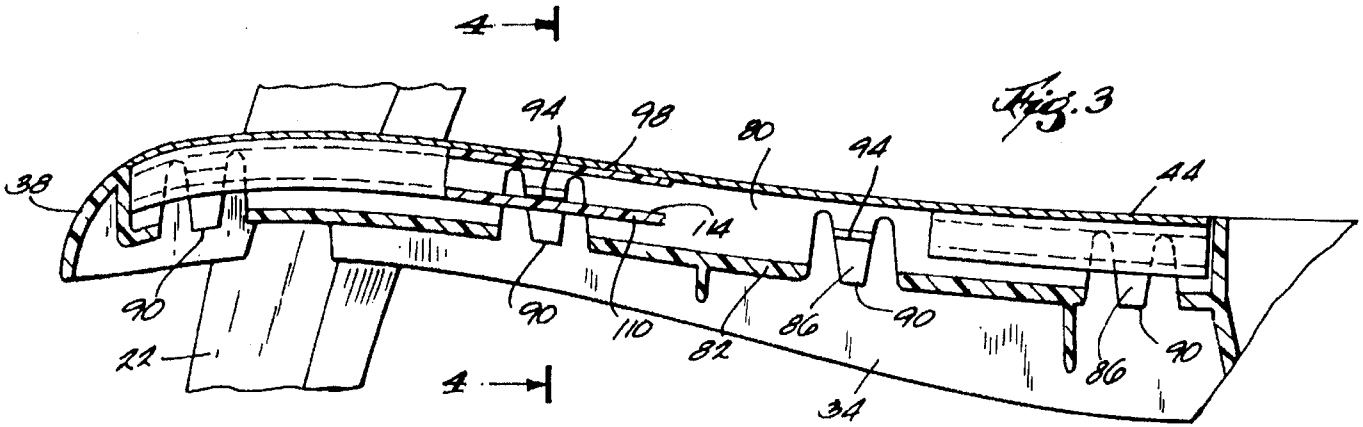
FIG. 3 is an enlarged, cross-sectional view taken along line 3—3 FIG. 1.

More specifically, and as best shown in FIG. 2, the seat 30 includes a pair of seat frame side members 34 (one shown in FIG. 2), a seat frame front member 38 which extends between the forward ends of the seat frame side members 34, and a seat support 42 which extends between the seat frame side members 34 at a position located near the rearward ends of the seat frame side members 34. The seat frame side members 34 are mirror images of each other and, for the purpose of description, the seat frame member 34 shown in FIG. 2 will be discussed in detail with the understanding that the other seat frame side member 34 is similarly constructed.

Figure 5:
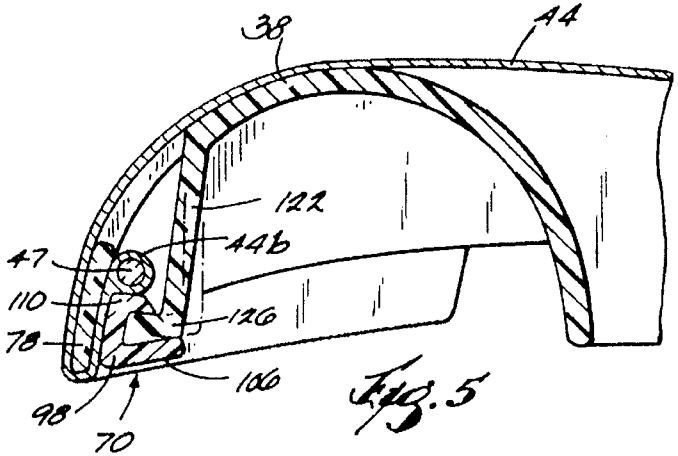
FIG. 5 is an enlarged, cross-sectional view taken along line 5—5 in FIG. 1.
Figure 6:
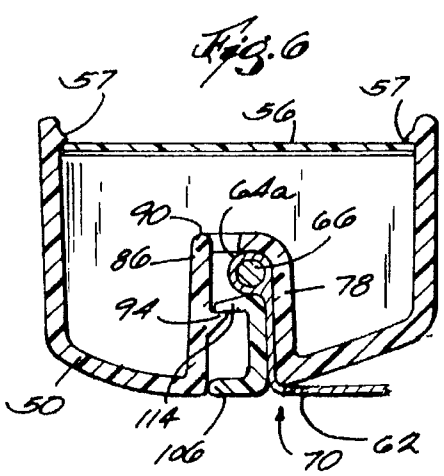
FIG. 6 is an enlarged, cross-sectional view taken along line 6—6 in FIG. 1.
Figure 4:
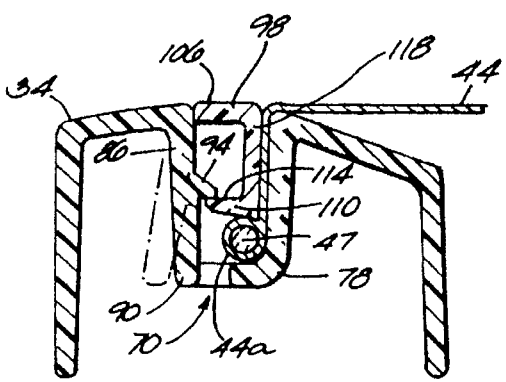
FIG. 4 is an enlarged, cross-sectional view taken along line 4—4 in FIGS. 1 and 3.

The seat 30 also includes a web of seat fabric 44 which is attached to the seat frame side members 34 and the seat frame front member 38 in a manner discussed in detail below. The seat fabric 44 is generally rectangular and, as best shown in FIG. 2, the seat fabric has a cut-out portions 46 such that the seat fabric 44 has a pair of edges **44*a* which can be attached to respective seat frame side members 34 and an edge 44*b* which can be wrapped over and attached to the seat frame front member 38. For reasons discussed below, and as best shown in FIGS. 4–6, the edges 44*a*, 44*b* of the seat fabric 44 each include a welting 47. The welting 47** is formed by a sleeve of fabric and a core or bead of relatively incompressible material, such as metal or an extruded plastic rod, which is enclosed by the sleeve.

The chair 10 also includes a backrest 48. The backrest 48 includes a pair of backrest side members 50, which have respective lower ends 54 (only one shown in FIGS. 1 and 2) received by respective sockets in the seat frame side members 34 to support the backrest 48 on the seat frame 14. The backrest side members 50 are (FIG. 6) generally hollow and define a rearwardly opening cavity which is closed by a removable backrest cavity cover plate 56. The backrest cavity cover plate 56 is held in position by a series of detents 57 which are located on the backrest side members 50 and which resiliently engage the edges of the backrest cavity cover plate 56 and hold the cover plate 56 in position. The backrest side members 50 are mirror images of each other and, for the purpose of description, the backrest side member 50 shown in FIG. 6 will be discussed in detail with the understanding that the other backrest side member 50 is similarly constructed.

The backrest 48 also includes an upper backrest cross member 58 extending between the upper ends of the backrest side members 50 and a lower backrest cross member (not shown) extending between the backrest side members 50 adjacent the lower ends thereof.

The backrest 48 also includes a web of backrest fabric 62 which is similar to the web of seat fabric 44 and which also includes cut-out portions 63-such that the backrest fabric 612 has opposite side edges 64*a* which can be attached to the backrest side members 50 in a manner discussed immediately below, and an upper edge (not shown) which can be wrapped around and attached to the upper backrest cross member 58.

The chair 10 also includes means 70 for attaching the webs of fabric 44, 62 to the frame members of the seat frame 14 and backrest 48. While various suitable constructions can be successfully used, in the illustrated embodiment, such attachment means 70 includes a channel 74 formed in the seat frame side members 34. More particularly, each side member 34 has an outer wall 75 having an outer or upper surface 76, and the channel 74 is formed in the outer surface 76 of the outer wall 75.

The channel 74 extends along the length of the seat frame side member 34, has opposite forward and rearward ends and opens upwardly. As best shown in FIG. 4, the channel 74 is defined by a pair of sidewalls 78 and 80 which are, in general, relatively rigid, and which are connected by a bottom wall 82. More particularly, the sidewall 78 is a fixed wall 78. Along the length of the channel 74, the sidewall 80 has cut out portions which define deflectable wall portions 86. The deflectable wall portions 86 extend in cantilever fashion from the outer wall 75 and are resiliently movable between a first position (shown in FIG. 4) and a second, retracted position (shown in phantom in FIG. 4) wherein the edge 90 and detent 94 of the deflectable wall portion 86 are moved away from the fixed wall portion 78.

The attachment means 70 also includes a retainer strip 98 which can be received by the channel 74 and engaged by the detent 94. As best shown in FIG. 4, the retainer strip 98 has a u-shaped or c-shaped cross section and a length approximating the length of the channel 74. The u-shaped cross section of the retainer strip 98 is provided by a first or upper sidewall 102 which provides an surface 106 that faces outwardly of the u-shaped cross-section and which, when the retainer strip is received by the channel 74, is exposed. The retainer strip 98 also includes a second or lower sidewall or locking wall 110 which provides an engagement surface 114 that faces inwardly of the u-shaped cross section. The retainer strip 98 also includes a connecting wall 118 extending between the first and second sidewalls 102, 110.

The retainer strip is engageable with the deflectable wall portion 86 so as to be locked into place and, when the fabric 44 is placed in the channel 74, the retaining strip engages the fabric and holds it in position against the fixed wall 78 of the seat frame side member 34 through engagement of the locking wall 110 with the welting 47.

More particularly, the fabric 44 can be attached to the seat frame 14 as follows: First, the side portion and edge 44*a* of the seat fabric 44 is wrapped over the upper surface of the frame side member 34 and the welting 47 is placed into the channel 74 so that the edge 44*a* of the seat fabric 44 is adjacent the bottom wall 82. Once the fabric is so positioned, the retainer strip 98 can be inserted into the channel 74 and pressed down into engagement with the deflectable wall portions 86. When so engaged, the engagement surface 114 on the locking wall 110 of the retainer strip 98 engages the lower surface of the detent 94 to hold the retainer strip 98 in position. Also when the retainer strip 98 is so received by the channel 74, the exposed wall 102 is preferably substantially flush with the upper surface of the seat frame side member 34.

In the event that the fabric 44 needs to be removed from the seat 30, the attachment means 70 can be released so that the edge 44*a* of the fabric 44 is no longer clamped between the retainer strip 98 and the frame member 34. More particularly, the attachment means 70 can be released by moving the lower edge 90 of each deflectable wall 86 away from the fixed wall 78 so as to move the detent 94 out of engagement with the surface 114 of the locking wall 110. When each moveable wall 86 is so deflected, the retainer strip 98 can be remove from the channel 74 to thereby release the edge 44*a* of the seat fabric 44.

The attachment means 70 also includes means on the seat frame front member 38 for engaging the seat fabric 44. As best shown in FIG. 5, the arrangement on the seat frame front member 38 for attaching the fabric 44 to the seat frame 14 is substantially similar to that of the seat frame side members 34, with slight differences. The most significant difference in the construction of the seat frame front member 38 is the provision of a deflectable wall 122 which provides a detent 126 located at the edge of the deflectable wall 122 rather than spaced away from the edge. The deflectable wall 122, particularly the detent 126, is engageable with a retainer strip 98 which is received in a channel 74 (which faces downwardly in the seat frame front member 38). The side portion including edge 44*b* of the seat fabric 44 is wrapped over the upper surface of the seat frame front member 38 and the edge 44*b* and welting 47 is placed into the channel 74 so that the edge 44*b* is positioned adjacent upper edge of the fixed wall 78. Once the fabric is so positioned, the retainer strip 98 can be inserted into the channel 74 and pressed into engagement with the detent 126.

The welting 47 is thus captured between the retainer strip 98 and the fixed wall 78 of the seat frame front member 38, and the fabric is attached to the seat frame front member 38. Like the deflectable wall 86 in the seat frame side member, the deflectable wall 122 on the seat frame front member is movable to release the retainer strip 98 from engagement with the detent 126 and so that the retainer strip 98 can be removed from the channel 74 and to thereby release the edge 44*b* of the fabric 44.

The attachment means 70 also includes similar structure on the backrest side members 50. In particular, and as best shown in FIG. 6, the backrest side members 50 define rearwardly opening channels 74 defined by a fixed wall 78 and deflectable wall portions 86 each having an edge 90 and a detent 94. A retainer strip 98 is can be received by the channel 74 to lock the edge of the backrest fabric 62 into the channel 74. In the event that the backrest fabric 62 needs to be removed, access to the attachment means 70 on the backrest 48 can be gained by removing the backrest cavity cover plate 56. Each deflectable wall portion 86 can then be moved to its second position (not shown in FIG. 6) to release the detent 94 from engagement with the engagement surface 114, thereby permitting the retainer strip to be removed from the channel 74 and releasing the backrest fabric 62.

The upper edge of the backrest fabric 64 is secured to the backrest cross member 58 in a manner substantially identical to that in which the edge **44*b* of the seat fabric 44 is secured to the seat cross member 38**.

Various features of the invention are set forth in the following claims.

I claim:

1. A chair assembly comprising a frame including an outer wall having an outer surface, said outer surface having therein a channel defined by fixed wall extending inwardly from said outer wall, and a resiliently deflectable wall extending inwardly in cantilever fashion from said outer wall, said deflectable wall being spaced from said fixed wall to define said channel between said fixed wall and said deflectable wall, a retainer received by said channel and removably secured in said channel by said deflectable wall, and a web of fabric engaging said outer surface of said outer wall and having an edge located in said channel and engaged with said retainer and said frame, whereby said web is releasably fixed to said frame.

2. A chair assembly as set forth in claim 1 wherein said web has a welting extending along a portion of said edge, and wherein said frame and said retainer engage said web along the length of said edge of said web adjacent said welting.

3. A chair assembly as set forth in claim 1 wherein said frame includes a first member which has therein said channel and which includes said outer wall, said fixed wall and said deflectable wall, said frame also including a second frame member which includes a second outer wall having an outer surface, said outer surface of said second outer wall having therein a second channel defined by a second fixed wall extending inwardly from said second outer wall, and a second resiliently deflectable wall extending inwardly in cantilever fashion from said second outer wall, said second deflectable wall being spaced from said second fixed wall to define said second channel between said second fixed wall and said second deflectable wall, said assembly further including a second retainer removably secured in said second channel by said second deflectable wall, and wherein said web of fabric extends over said outer surface of said second outer wall and has an edge located in said second channel and engaged with said second retainer and said second frame member, whereby said web of fabric provides a support surface extending between said first and second frame members.

4. A chair assembly as set forth in claim 1 wherein said deflectable wall has a detent engageable with said retainer.

5. A chair assembly as set forth in claim 1 wherein said frame defines an opening affording access to the deflectable wall, and further including a cover plate which is supported by said frame and which closes said opening.

6. A chair assembly as set forth in claim 1 wherein said fabric is secured between said fixed wall and said retainer.

7. A chair assembly as set forth in claim 1 wherein said frame also includes a second fixed wall opposite said first-mentioned fixed wall, and a bottom wall which extends between said first-mentioned fixed wall and said second fixed wall and which further defines said channel, and wherein said second fixed wall has therein cut-out portions defining said deflectable wall.

8. A chair assembly as set forth in claim 1 wherein said frame has a side opposite said outer surface of said outer wall, and wherein said deflectable wall is accessible from said side of said frame to release said retainer and said fabric from said channel.

9. A chair assembly as set forth in claim 1 wherein said fabric is secured between said retainer and one of said fixed wall and said deflectable wall, wherein said retainer has an outer surface, and wherein said fabric does not overlap said outer surface of said retainer.

10. A chair assembly as set forth in claim 9 wherein said outer surface of said retainer is substantially flush with said outer surface of said outer wall.

11. A chair assembly as set forth in claim 1 wherein said fabric is secured between said fixed wall and said retainer, wherein said web has a welting extending along a portion of said edge, wherein said fixed wall and said retainer engage said web along the length of said edge adjacent said welting, wherein said frame also includes a second fixed wall opposite said first-mentioned fixed wall, and a bottom wall which extends between said first-mentioned fixed wall and said-second fixed wall and which further defines said channel, wherein said second fixed wall has therein cut-out portions defining said deflectable wall, wherein said deflectable wall has a detent engageable with said retainer, wherein said retainer has an outer surface substantially flush with said outer surface of said outer wall, wherein said fabric does not overlap said outer surface of said retainer, wherein said frame has a side opposite said outer surface of said outer wall, and wherein said deflectable wall is accessible from said side of said frame to release said retainer and said fabric from said channel.

12. A chair assembly as set forth in claim 11 wherein said chair and said retainer are made of injection-molded plastic.

13. A chair assembly as set forth in claim 11 wherein said frame defines an opening affording access to the deflectable wall, and further including a cover plate which is supported by said frame and which closes said opening.

14. A chair assembly comprising a frame including a fixed wall and a resiliently deflectable wall spaced from said fixed wall to define a channel between said fixed wall and said deflectable wall, a retainer received by said channel and removably secured in said channel by said deflectable wall, said retainer having an outer surface, and a web of fabric having an edge located in said channel and secured between said retainer and said fixed wall, whereby said web is releasably fixed to said frame, and such that said fabric does not overlap said outer surface of said retainer.

15. A chair assembly as set forth in claim 14 wherein said retainer has a first surface engageable with said deflectable wall and a second surface engageable with said fabric.

16. A chair assembly as set forth in claim 14 wherein said web has a welting extending along a portion of said edge, and wherein said frame and said retainer engaged said web along the length of said edge of said web adjacent said welting.

17. A chair assembly as set forth in claim 14 wherein said frame includes a first member which has therein said channel and which includes said fixed wall and said deflectable wall, said frame also including a second frame member including a second fixed wall and a second resiliently deflectable wall spaced from said second fixed wall to define a second channel between said second fixed wall and said second deflectable wall, said assembly further including a second retainer removably secured in said second channel by said second deflectable wall, said second retainer having an outer surface, and wherein said web of fabric has an edge located in said second channel and secured between said second retainer and said second fixed wall, such that said fabric does not overlap said outer surface of said second retainer, whereby said web of fabric provides a support surface extending between said first and second frame members.

18. A chair assembly as set forth in claim 14 wherein said deflectable wall has a detent engageable with said retainer.

19. A chair assembly as set forth in claim 14 wherein said frame defines an opening affording access to the deflectable wall, and further including a cover plate which is supported by said frame and which closes said opening.

20. A chair assembly comprising a frame including a channel and a resiliently deflectable wall, said frame defining an opening affording access to the deflectable wall, a retainer received by said channel and removably secured said channel by said deflectable wall, a web fabric located in said channel and engaged with said retainer and said frame, whereby said web is releasably fixed to said frame, and a cover plate which is supported by said frame and which closes said opening.

* * * * *

UNITED STATES PATENT AND TRADEMARK OFFICE

CERTIFICATE OF CORRECTION

PATENT NO. : 5,662,383
DATED : September 2, 1997
INVENTOR(S) : Joseph M. Hand

It is certified that error appears in the above-indentified patent and that said Letters Patent is hereby corrected as shown below:

Column 3, line 22, after "portions", delete ---63---.

Column 3, line 23, delete "612", and insert ---62---.

Column 5, line 10, after "by", insert ---a---.

Signed and Sealed this

Eighteenth Day of November 1997

*Attest:*

Bruce Lehman

BRUCE LEHMAN

*Attesting Officer*

*Commissioner of Patents and Trademarks*